US005248216A

United States Patent [19]

Vural

[11] Patent Number: 5,248,216

[45] Date of Patent: Sep. 28, 1993

[54] COMPACTOR

[75] Inventor: Gülertan Vural, Emmelshausen, Fed. Rep. of Germany

[73] Assignee: BOMAG GmbH, Boppard, Fed. Rep. of Germany

[21] Appl. No.: 940,344

[22] Filed: Sep. 3, 1992

[30] Foreign Application Priority Data

Sep. 3, 1991 [DE] Fed. Rep. of Germany ..... 4129182

[51] Int. Cl.[5] ..... E01C 19/00

[52] U.S. Cl. ..... 404/75; 404/117

[58] Field of Search ..... 404/75, 117, 121-124

[56] References Cited

U.S. PATENT DOCUMENTS 3,543,656 12/1970 Roettger .
4,732,507 3/1988 Artzberger ..... 404/117
4,737,050 4/1988 Halim ..... 404/75
4,749,305 6/1988 Brown et al. ..... 404/117
4,878,544 11/1989 Barnhart ..... 404/117 X

FOREIGN PATENT DOCUMENTS 0053598 9/1984 European Pat. Off. .

*Primary Examiner*—Thuy M. Bui
*Attorney, Agent, or Firm*—Spencer, Frank & Schneider

[57] ABSTRACT

The present invention relates to a soil compactor equipped with at least one movable drum. To generate the desired compacting forces, the drum is equipped with two oppositely rotating exciter shafts which are matched to one another in their phase positions so that, if the exciter shafts are vertically superposed, their centrifugal forces act horizontally and in the same direction, thus causing a moment free horizontal force to be exerted on the drum axis, while, with the exciter shafts disposed in a juxtaposed arrangement, the centrifugal forces are amplified in the vertical direction and compensate one another in the horizontal direction.

12 Claims, 4 Drawing Sheets

FIG. 3
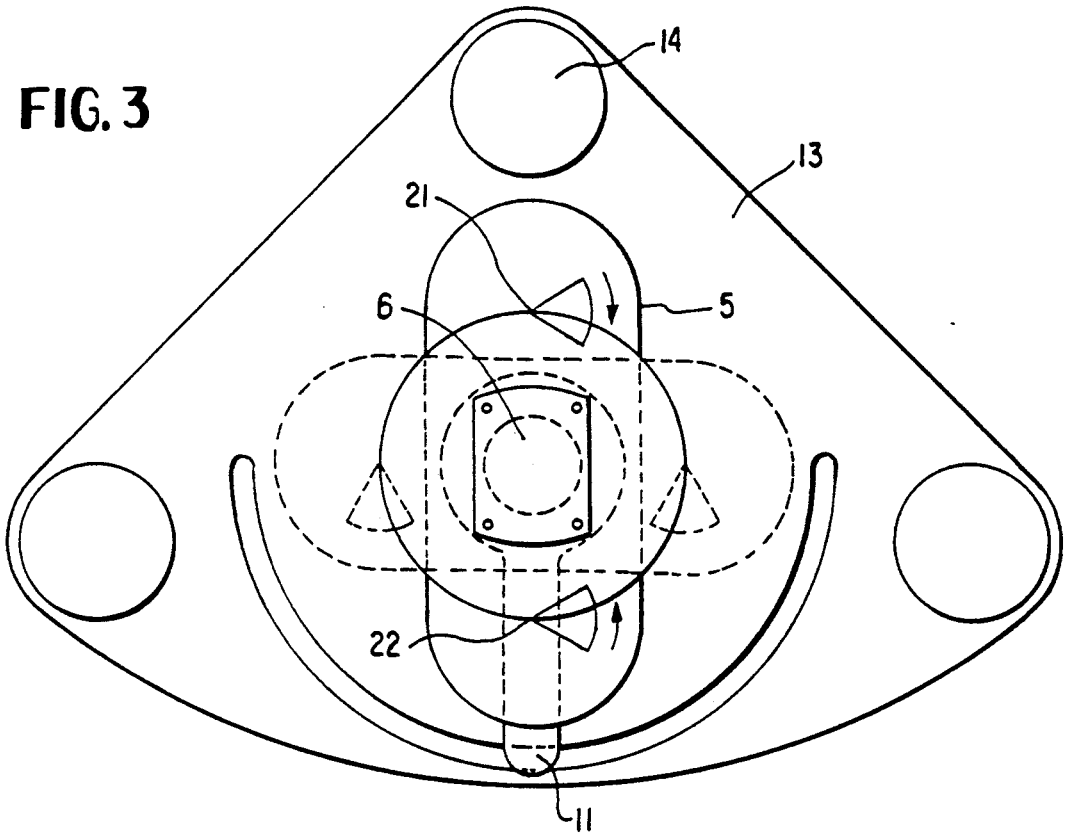
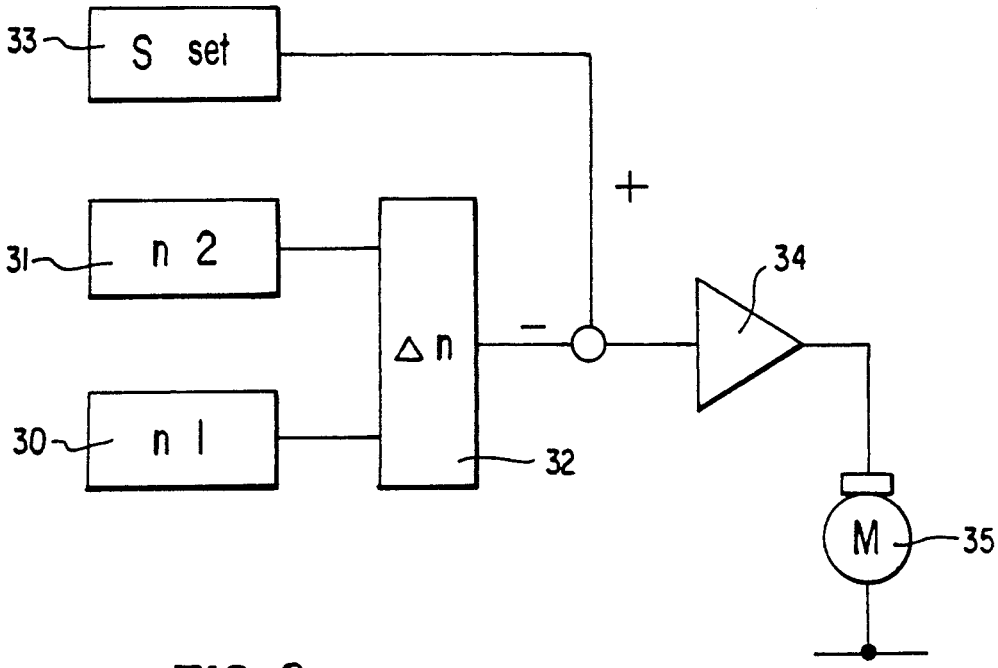
FIG. 6

COMPACTOR

CROSS REFERENCE TO RELATED APPLICATION

This application claims the priority of application Ser. No. P 41 29 182.4, filed Sep. 3, 1991, in the Federal Republic of Germany, the subject matter of which is incorporated herein by reference.

BACKGROUND OF THE INVENTION

The present invention relates to a device for compacting soil, the device including at least one movable drum which is in operative connection with eccentric exciter shafts that are arranged parallel to the drum axis and rotate in synchronism so that the drum selectively exerts primarily a dynamic shearing force or a pressure force on the soil.

Such a compacting device is disclosed in EP-B 0,053,598. It includes two exciter shafts which rotate in the same sense of rotation but are shifted in phase by 180 °. In this way, the vertical forces generated by the exciter shafts compensate one another while the oppositely directed horizontal forces generate a torque on the drum about the drum axis. This torque causes a predominant shear force to act on the soil which is of advantage when compacting thin layers of soil.

In the majority of cases, the soil must also be compacted in depth. For this purpose it is necessary for the drum to exert primarily a pressure force on the soil. To accomplish this, the phase difference between the two exciter shafts in the mentioned device must be reduced from 180° to 0°. The excitation forces generated by the eccentric masses then rotate in the same sense and in the same phase so that, depending on the angular position of the exciter shafts, vertical pressure forces are also exerted on the soil.

Based on this state of the art, applicant's tests have shown the following:

Although the generation of pure torques about the drum axis leads to a certain reduction of vibration stresses on the vehicle structure, it creates, on the other hand, a slip between the drum and the soil surface. This results in traction problems if the compaction drum must be used on a downhill or an uphill slope. This problem is augmented if the described system is employed in compaction devices employing two oscillating drums because then no rubber wheels are available to guide the compactor.

Additionally, bituminous materials may develop undesirable waves and smoothing of the surfaces.

Finally, the structural expenditures are also rather high because the exciter shafts must be mounted far away from the drum axis in order to generate the desired torque and because additionally the one exciter shaft must be provided with adjustable flyweights.

SUMMARY OF THE INVENTION

Based on the above, it is an object of the present invention to produce, in a compactor of the above-mentioned type, an oscillating shear force on the soil without encountering the described slip phenomena. The apparatus according to the invention should also remain suitable for compacting greater thicknesses of soil by means of primarily dynamic pressure forces and should be distinguished by a simple structure.

This is accomplished according to the invention in that the exciter shafts no longer rotate in the same sense but in opposite directions and that they are adapted to one another in their phase position in such a way that, with their exciter shafts disposed vertically superposed, their centrifugal forces act approximately horizontally and in the same direction so that a horizontal force that is free of moments acts on the drum axis.

The present invention is thus based on the realization that the torque generated in the prior art about the drum axis should be replaced by horizontal forces whose resultant acts in the drum axis and subjects it to a translatory displacement movement.

Tests made by applicant have shown that the original generation of a displacement movement instead of a pure torque is connected with substantially less danger of slip. Thus the steerability and simultaneously also the compacting power of the compactor are improved.

Additionally, the structural configuration of the compacting system becomes simpler because the exciter shafts need no longer be installed with a long lever arm at a distance from the drum axis but can be disposed in its immediate vicinity and can be driven directly from the center of the drum. Drive belts or the like are no longer required.

Although the generation of shear stresses as a result of translatory displacement forces is already disclosed in U.S. Pat. No. 3,543,656, that system provides only one exciter shaft per drum so that the question of the direction of rotation and the phase shift between associated exciter shafts does not arise there. Additionally the translatory displacement movement there always has a certain torque on the drum superposed on it so that both effects exist next to one another.

In order for the centrifugal forces generated by the exciter shafts to act only in the desired direction, it is recommended to arrange them in such a way that their bearing does not participate in the rotary movement of the drum but that they are instead supported in a frame relative to which the drum rotates. Thus the action of the vibratory forces is independent of the rotation of the drum.

In this connection it is particularly favorable if the frame is pivotal about an axis that is parallel to the exciter shafts and can be fixed in the desired pivoted position so that the exciter shafts can be operated not only in their superposed position but also in a position in which they are, for example, disposed vertically next to one another and particularly in any position therebetween. In this way, the horizontal shear force compaction can be combined as desired with the conventional vertical compaction.

Tests performed by applicant have shown that such a combined compaction in which the forces pulsate in the horizontal as well as in the vertical direction results in a considerable improvement of the compaction effect. For this purpose, it is recommended to make the frame arrestable in a plurality of pivoted positions within an angular range between 10° and 80°, preferably between about 15° and about 75°, particularly between about 20° and about 70°, either on one side or on both sides of a reference position in which the exciter shafts are vertically superposed.

The possibility of being able to rotate the frame not only in the one pivoting direction but also in the opposite direction offers the advantage that the resulting horizontal force ca be adapted to the direction of travel and thus supports the driving power instead of counteracting it.

A suitable modification of the compactor according to the invention resides in the provision of a comparison element which, on the one hand, receives signals from a path sensor regarding the actual path traveled and, on the other hand, signals about the set path derived from the drive system. If a certain difference between the two signals is exceeded, that is, a certain slip is exceeded, an adjustment member is activated which pivots the housing in the sense of reducing the horizontal force generated by the exciter shafts.

In this way, one obtains quasi an anti-slip control which, if the slip becomes unduly high, automatically reduces the horizontal forces that cause it and simultaneously increase the vertical forces that counteract slipping.

It is within the scope of the present invention to integrate this slip limitation in a control process in such a manner that the machine always operates with the maximum permissible slip.

Since the permissible slip is a function of the respective terrain, it is recommended that the decisive limit value be predetermined by means of a set point generator. In this way, the permissible slip can be optimally adapted to the consistency of the soil and the steepness of the terrain.

For space reasons, the frame and the exciter shafts are advisably disposed in the interior of the drum. In the simplest case, they are mounted on the same shaft about which the drum revolves.

BRIEF DESCRIPTION OF THE DRAWINGS

Further features and advantages of the invention will become evident from the description below of an embodiment of the invention with reference to the drawings, in which:

FIG. 3 is a front view seen in the direction of the arrow in FIG. 2;

FIG. 6 is a schematic representation of a slip limitation system.

DESCRIPTION OF THE PREFERRED EMBODIMENT

Figure 1:
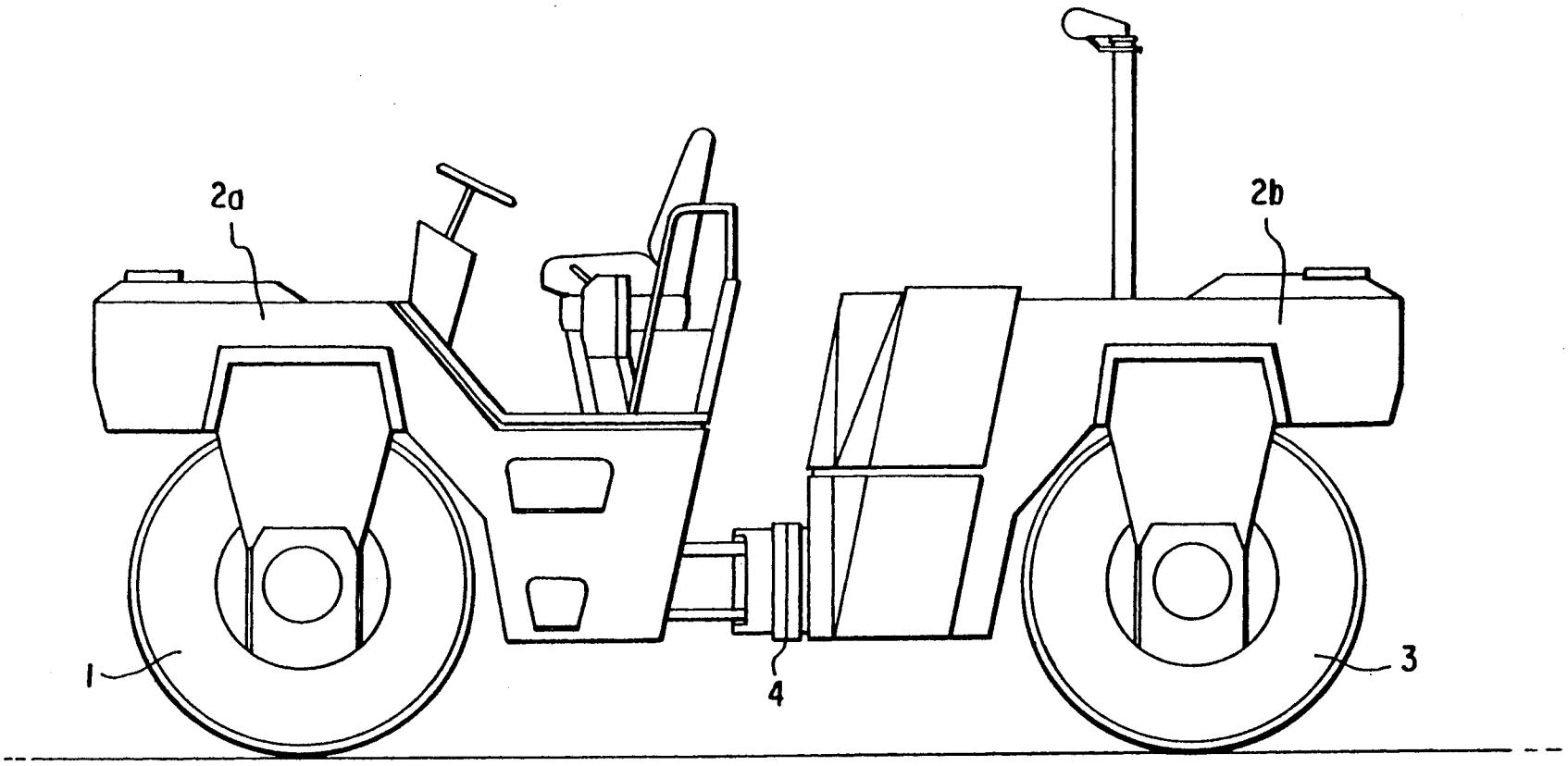
FIG. 1 is a side view of the compactor in its entirety.

FIG. 1 shows a compactor equipped with two vibratory drums. Judging from its exterior, the compactor is of conventional construction, that is, it is composed of a front drum 1, a body portion 2*a* and a driver's seat as well as a rear drum 3 and a body portion 2*b*, with the two body portions 2*a* and 2*b* being connected with one another by means of a vertical pivot bearing 4 in order to enable the vehicle to be steered.

Figure 2:
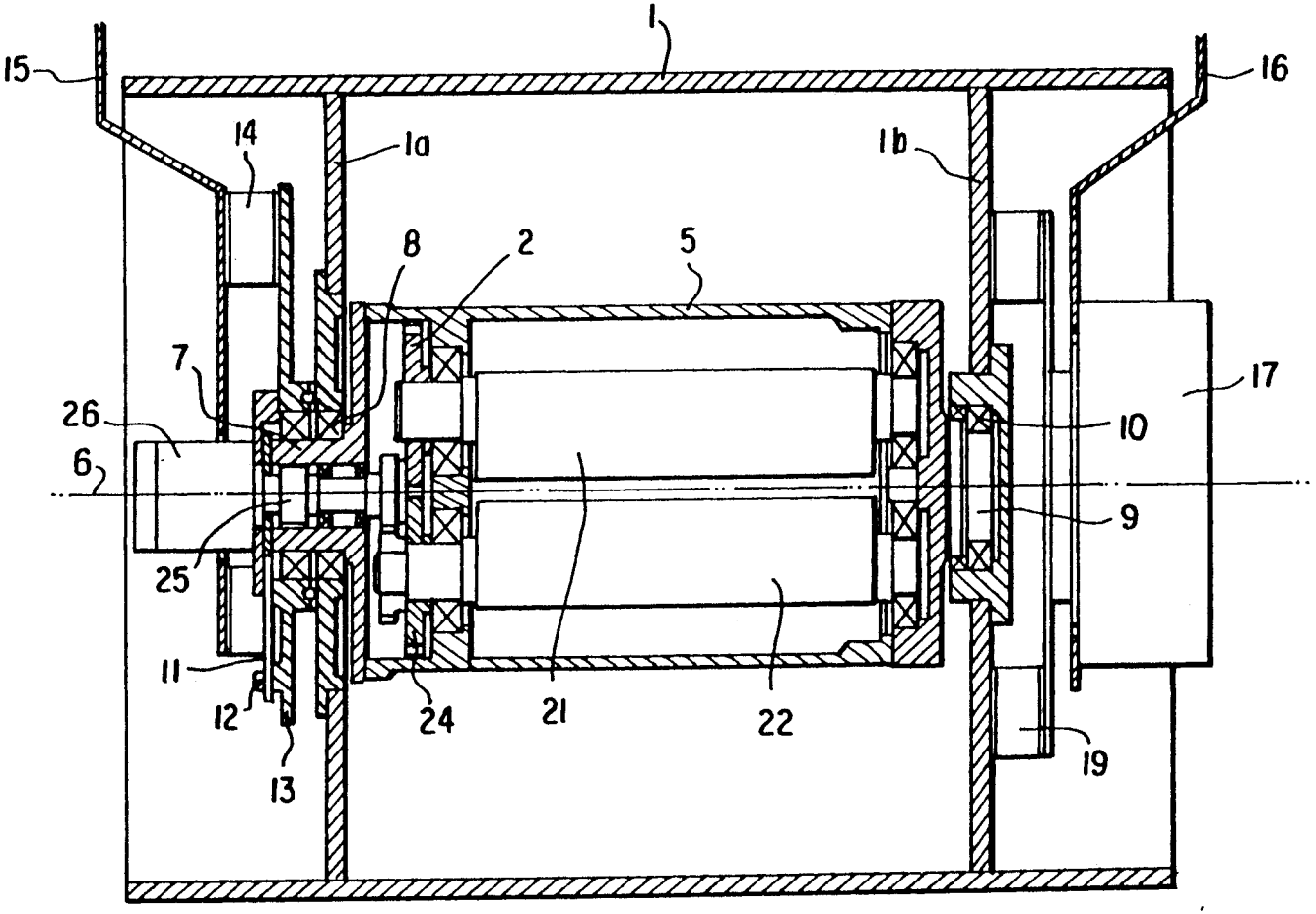
FIG. 2 is an enlarged axial sectional view of a drum.

The configuration of the vibration generator is evident from FIG. 2. It can be seen that an exciter housing 5 is disposed in the interior of drum 1 and is pivotal about drum axis 6. For this purpose, the exciter housing is provided at its one end with a projecting collar 7 on which the one end wall 1*a* of the drum is mounted by way of a roller bearing 8. At the other end, exciter housing 5 is similarly mounted by way of a collar 9 and a roller bearing 10 in the corresponding end wall 1*b* of the drum.

However, collar 7 is extended considerably toward the exterior and is there provided with an adjustment lever 11. This adjustment lever can be fixed in different pivoted positions by means of screws 12 or the like to the drive bearing flange 13. Its adjustment may be performed manually; advisably, however, it is done automatically, perhaps by means of a hydraulic cylinder.

Finally, drive bearing flange 13 is resiliently connected in the usual manner by means of several rubber elements 14 with a frame support 15 on body portion 2*a*.

At the opposite end of the drum, a similar frame support 16 is provided which supports the drive motor 17 together with the drum bearing that is integrated therein. The drums are driven by means of a drive disk 18 and several rubber elements 19 which, in turn, are connected with the end wall 1*b* of the drum.

As further shown in the drawing, two exciter shafts 21 and 22 equipped with eccentric weights are mounted at equal distances and parallel to drum axis 6 in exciter housing 5. The two exciter shafts are in engagement with each other by means of gears 23 and 24 so that they rotate in opposite directions. They are driven by further gears and a coupling in the form of a shaft 25 which passes coaxially through collar and is connected with a hydraulic motor 26.

Figure 4:
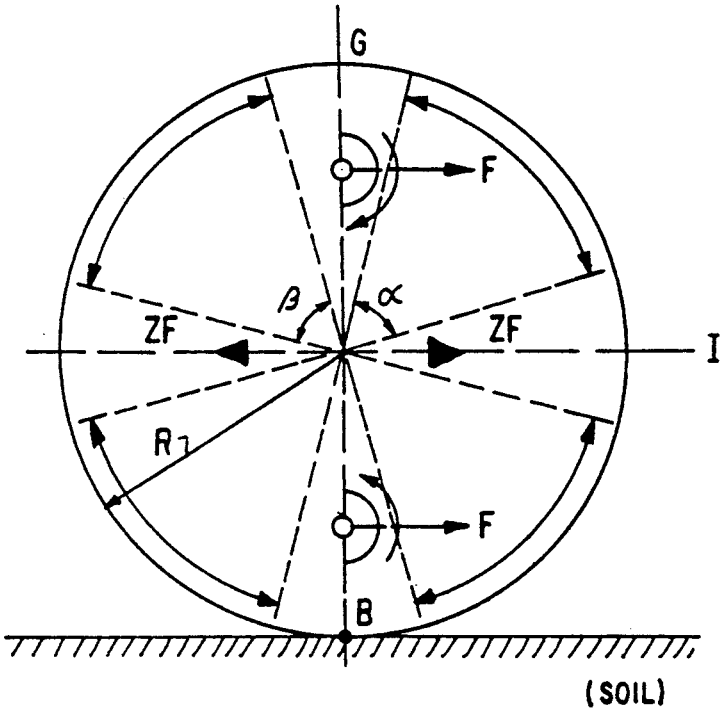
FIG. 4 is a schematic representation of the reaction forces if the exciter shafts are superposed.

The operation of the exciter shafts becomes evident from FIGS. 3 and 4. It can there be seen that the phase position of the two exciter shafts is selected so that the centrifugal forces generated by the eccentric weights are amplified in the horizontal direction but compensate one another in the vertical direction. This generates resulting horizontal forces that act on the drum shaft 6 and act alternatingly, according to the direction of rotation of the exciter shafts, in the direction of travel or opposite to it. Accordingly, the drum is subjected to the desired vibrations in the horizontal direction, with the resulting centrifugal force not generating a torque on the drum since it is directed onto the center of the drum.

Figure 5:
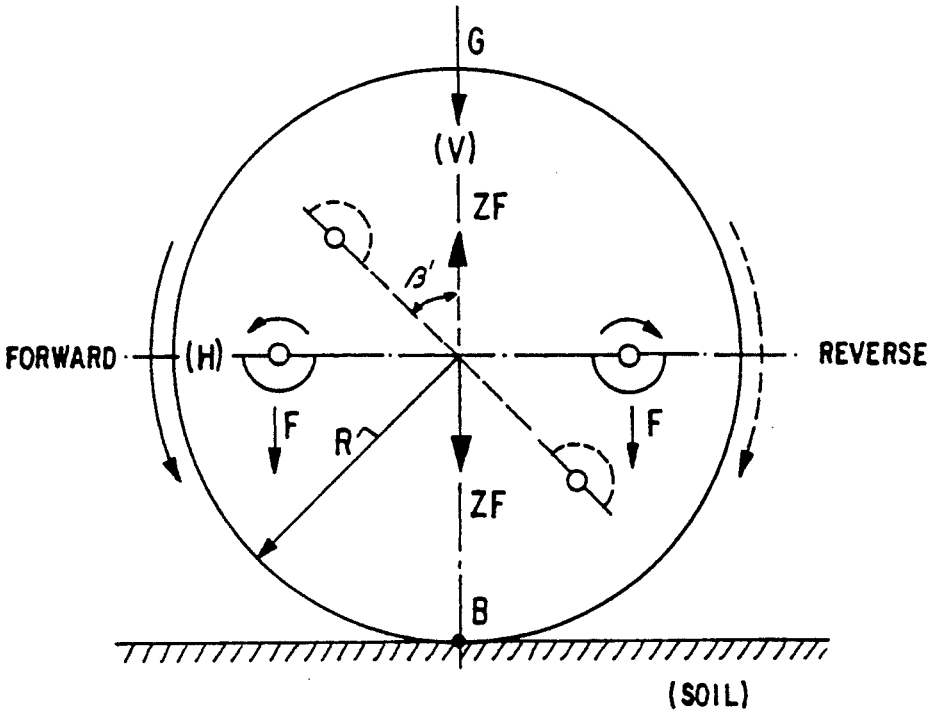
FIG. 5 is a schematic representation of the reaction forces if the exciter shafts are juxtaposed.

If, however, the compaction is to be effected only by vertical forces, adjustment lever 11 is pivoted about 90° to the left or to the right into the position shown in dashed lines and consequently exciter shafts 21 and 22 come to lie next to one another, see the illustration in dashed lines in FIG. 3 in conjunction with FIG. 5. The direction of rotation and phase position of the exciter shafts do not change, but the resulting forces exerted by them do change. As shown in FIG. 5, the centrifugal forces acting in the horizontal direction now cancel one another out while the centrifugal forces acting in the vertical direction are amplified. Thus compaction is effected purely by vertical forces.

As tests made by applicant have shown, optimum compaction conditions often develop if work is performed with mixtures between the two above-described compaction modes, with it particularly being the depth of the layer and also the consistency of the soil and other parameters which determine whether shear forces or dynamic vertical pressure forces are to be used primarily for the compaction. Here, the pivotal arrangement of the exciter housing 5 provides for the optimum adaptation to external conditions since it is possible to pivot the housing into any desired intermediate positions and to arrest it there by means of fastening elements 12. These intermediate positions are indicated in FIG. 4 by the angle ranges $\alpha$ and $\beta$.

These angle ranges extend preferably not to the two extreme positions shown in FIG. 3 in which either pure horizontal forces or pure vertical forces are generated; rather they begin, based on a reference position in which the exciter shafts are vertically superposed, as shown in FIG. 4, at an angle of about 10° to 20°. and they end at an angle of about 70° to 80°. These angle ranges represent the preferred adjustment range for exciter housing 5.

In this connection it is important that, starting from its vertical position, the exciter housing 5 can be pivoted clockwise as well as counterclockwise if it is intended to superpose vertical components on the horizontal centrifugal forces. If, for example, the exciter housing is pivoted counterclockwise about the angle $\beta'$, as shown by the dashed line in FIG. 5, a resulting centrifugal force is generated which acts perpendicularly to this dashed line, that is, depending on the phase position of the exciter shafts, either toward the bottom left, for example as shown by the radial arrow R, or in the opposite direction toward the top right. The force in the direction of radial arrow R also generates a certain torque about the line of contact B between the drum and the soil and thus supports the driving moment that moves the vehicle forward. In contrast thereto, the opposite direction of force toward the top right has hardly any influence on the driving moment because the upwardly directed centrifugal force component drastically reduces the pressure of the drum on the soil.

It is thus advisable to pivot the exciter housing into the $\beta$ range during forward travel and into the $\alpha$ range during reverse travel.

The adjustment of the position of the exciter housing is preferably effected automatically when the compactor changes its direction of travel. In this way, the portion of the centrifugal forces that have hardly any influence on the compaction itself are utilized for driving the compactor forward to thus improve its hill climbing ability.

FIG. 6 shows a slip limitation system. For this purpose, the compactor is provided with a path sensor 30 which detects the actual path traveled. This may be a static bandage, a drive wheel, a drum motor or a measuring wheel. The path traveled may also be detected by radar or ultrasound. In parallel thereto, an element 31 determines the set travel from the drive train, that is, for example, from the rotation angle of drum 1 or 3. Both path signals are fed to a comparison element 32 which determines the difference between the two signals, that is, the slip. If this slip lies above a predetermined limit value which can be set by means of a set point generator 33, an amplifier 34 activates a servomotor 35 which pivots exciter housing 5 in the sense of reducing the horizontal forces generated by exciter shafts 21 and 22 until the slip determined by comparison element 32 lies below the predetermined limit value.

In this way, the compaction parameters are automatically adapted to the consistency of the soil and to the slope of the terrain.

It will be understood that the above description of the present invention is susceptible to various modifications, changes and adaptations, and the same are intended to be comprehended within the meaning and range of equivalents of the appended claims.

What is claimed is: .

1. A device for compacting soil, the device including at least one movable drum which is in operative connection with eccentric exciter shafts arranged parallel to drum axes and rotating synchronously therewith in such a way that the drum exerts primarily shear or pressure forces on the soil, characterized in that the exciter shafts rotate in opposite directions and are matched to one another in their phase positions in such a way that, if the exciter shafts are arranged vertically on top of one another, their centrifugal forces act approximately horizontally and in the same direction so that a horizontal force free of moments is exerted on the drum axis.

2. A device according to claim 1, characterized in that the exciter shafts are mounted in a frame and the drum rotates relative to said frame.

3. A device according to claim 2, characterized in that the frame is pivotal about an axis that is parallel to the exciter shafts and can be fixed in the desired pivoted position so that the exciter shafts are displaced from an approximately superposed position into an approximately horizontally juxtaposed position.

4. A device according to claim 2, characterized in that the frame is disposed within the drum.

5. A device according to claim 4, characterized in that the frame is adjustable about the drum axis.

6. A device according to claim 3, characterized in that the frame includes a lever that projects from the drum at one end and is in turn arrestable at a flange of a drive bearing or at another stationary component.

7. A device according to claim 2, characterized in that the frame is pivotal with respect to a position in which the exciter shafts are vertically superposed by about 90° in at least one direction, preferably by about 90° in both directions, into a position in which the exciter shafts are in approximately mirror-image horizontal positions.

8. A device according to claim 3, characterized in that the frame is arrestable in a plurality of pivoted positions within an angular range from 10° to 80°, preferably from about 15° to about 75°, particularly from about 20° to about 70° on one or both sides of a reference position in which the eccentric shafts are vertically superposed.

9. A device according to claim 1, characterized in that it includes a comparison element which receives, on the one hand, signals from a path sensor regarding the actual path traveled and, on the other hand, signals from a signal generator regarding the set path determined from the drive system and that, if a certain difference between the signals is exceeded, that is, a certain slip has developed, an adjustment member is activated which pivots the housing in the sense of reducing the horizontal forces generated by the exciter shafts.

10. A device according to claim 9, characterized in that the permissible slip above which the adjustment member is activated is predetermined by a set point generator.

11. A method for the dynamic compaction of soil by means of at least one movable drum on which acts a horizontal and/or a vertical vibration force, comprising the steps of exerting an essentially torque free resulting centrifugal on the shaft of the drum to generated the vibration force and adjusting the direction of this resulting centrifugal force in different angular positions between horizontal and vertical so that the soil is subjected simultaneously to horizontal thrust forces and vertical pressure forces.

12. A method according to claim 11 further providing the step of maintaining the resulting centrifugal force generated by rotating exciter shafts at its direction during the rotation of the exciter shafts.

* * * * *